US005094171A

United States Patent [19]

Fujita

[11] Patent Number: 5,094,171

[45] Date of Patent: Mar. 10, 1992

[54] CABLE GUIDED PLATFORM ESCAPE VEHICLE WITH TUBULAR FRAME CONSTRUCTION

[75] Inventor: Tokume Fujita, Rio de Janeiro, Brazil

[73] Assignee: Petroleo Brasileiro S.A., Rio de Janeiro, Brazil

[21] Appl. No.: 534,051

[22] Filed: Jun. 6, 1990

[30] Foreign Application Priority Data

Jun. 20, 1989 [BR] Brazil ..... PI8902978

[51] Int. Cl.[5] ..... B61B 7/00; E01B 25/16

[52] U.S. Cl. ..... 104/115; 182/10; 182/193; 188/65.1

[58] Field of Search ..... 104/112, 113, 115, 173.1; 182/5, 7, 10, 11, 14, 72, 193, 235; 188/2 D, 65.1

[56] References Cited

U.S. PATENT DOCUMENTS

| | | | |
|---|---|---|---|
| 416,220 | 12/1889 | Grinnell | 104/112 X |
| 666,879 | 1/1901 | White | 182/193 X |
| 960,068 | 5/1910 | Brown | 182/193 |
| 3,040,678 | 6/1962 | McEwen | 104/112 X |
| 3,827,368 | 8/1974 | Garnier | 188/65.1 X |
| 4,773,510 | 9/1988 | Sato | 188/2 D X |
| 4,934,277 | 6/1990 | Smith et al. | 104/113 |

FOREIGN PATENT DOCUMENTS 253504 10/1930 Italy ..... 104/112

*Primary Examiner*—Robert J. Oberleitner
*Assistant Examiner*—S. Joseph Morano
*Attorney, Agent, or Firm*—Sughrue, Mion, Zinn, Macpeak & Seas

[57] ABSTRACT

A platform escape vehicle, particularly for rapid escape of a derrickman from his monkey-board on a drilling rig, consisting of two sheaves with double grooves mounted on parallel shafts, to take a wire rope, one sheave being provided with a dynamic brake and the other sheave being provided with hand-operated shoe brake; the sheaves being connected by parallel supporting straps, the sheaves plus aforesaid supporting straps together being connected to the mid-point of the body of the vehicle which is made up of two like-shaped pieces consisting of upper supports from one end of the pieces tubular members run towards one another and around the bottom of a seat and from the other end of which tubular members run down to practically meet at the mid-point of handle-bars which are provided with levers for hand-operation of shoe brake, from the meeting point of the tubular members springs another tubular member that curves outward while running down through a hole at the forward end of the seat until the end thereof becomes an inverted T shape.

2 Claims, 2 Drawing Sheets

CABLE GUIDED PLATFORM ESCAPE VEHICLE WITH TUBULAR FRAME CONSTRUCTION

FIELD OF THE INVENTION

This invention concerns a platform escape vehicle, particularly for the derrick-man to get away quickly and safely from his monkey-board on a drilling rig, so as to be out of danger.

BACKGROUND OF THE INVENTION

Means so far employed to enable derrickmen to get away quickly from his monkey-board on a drilling rig are rudimentary and known by derrickmen as a "Jeronimo". Such kinds of gear consist of two pulleys mounted on shafts parallel to an inverted T beam, which hangs down for the derrickman to sit on, and runs along a steel rope stretching from the monkey-board to the ground for a distance not less than twice the height of the drop, so as to diminish the angle of descent, and it is fitted with an equally rudimentary kind of brake, consisting of an iron bar made to work directly on the rope by means of a hand-operated lever, the kind of gear which must be installed on all shore rigs, though not on all offshore rigs, since a lack of space at the latter would make the angle of descent of steel rope too steep.

However such kind of gear does not afford much protection to the derrickman because it is rudimentary in design, normal safety requirements are ignored, a derrickman having to come down from his monkey-board practically clinging on to it, if he is to keep his balance, while it is also pretty dangerous to get to the gear, for the derrickman has to stand up on the handrail to do so.

To overcome such difficulties this invention provides an escape vehicle, particularly for the derrickman to quickly escape from his monkey-board on a drilling rig, and to do so safely.

SUMMARY OF THE INVENTION

The invention consists of two double-grooved sheaves, mounted on parallel shafts and running on a steel rope, one of the sheaves being provided with dynamic braking and the other with manually-operated brake shoes, the sheaves being connected by parallel supporting straps, the sheaves and supporting straps being joined mid-way to the body of the vehicle, which consists of two like-shaped upper side pieces, from the shorter end of which a first tubular member runs downward to become the sides of a seat, and from the longer end of which a second tubular members runs downward and practically meets at handle-bars provided with levers to hand-operate brake shoes, and at the meeting point a third tubular members runs downward and curves outwards while passing through a hole in the fore part of the seat, and finally ends up as an inverted T-shaped tube for the derrickman to rest his feet on, it being also intended that when such vehicle is fixed on to the monkey board an easy way from the latter to the vehicle be provided.

In the description provided below, where reference is made to numbered parts, an example will be shown of a preferred design of this invention, and respective advantages thereof, though such example is not to be regarded as limiting the scope of this invention, all of which is illustrated in the attached drawings.

DESCRIPTION OF THE PREFERRED EMBODIMENT

Figure 1:
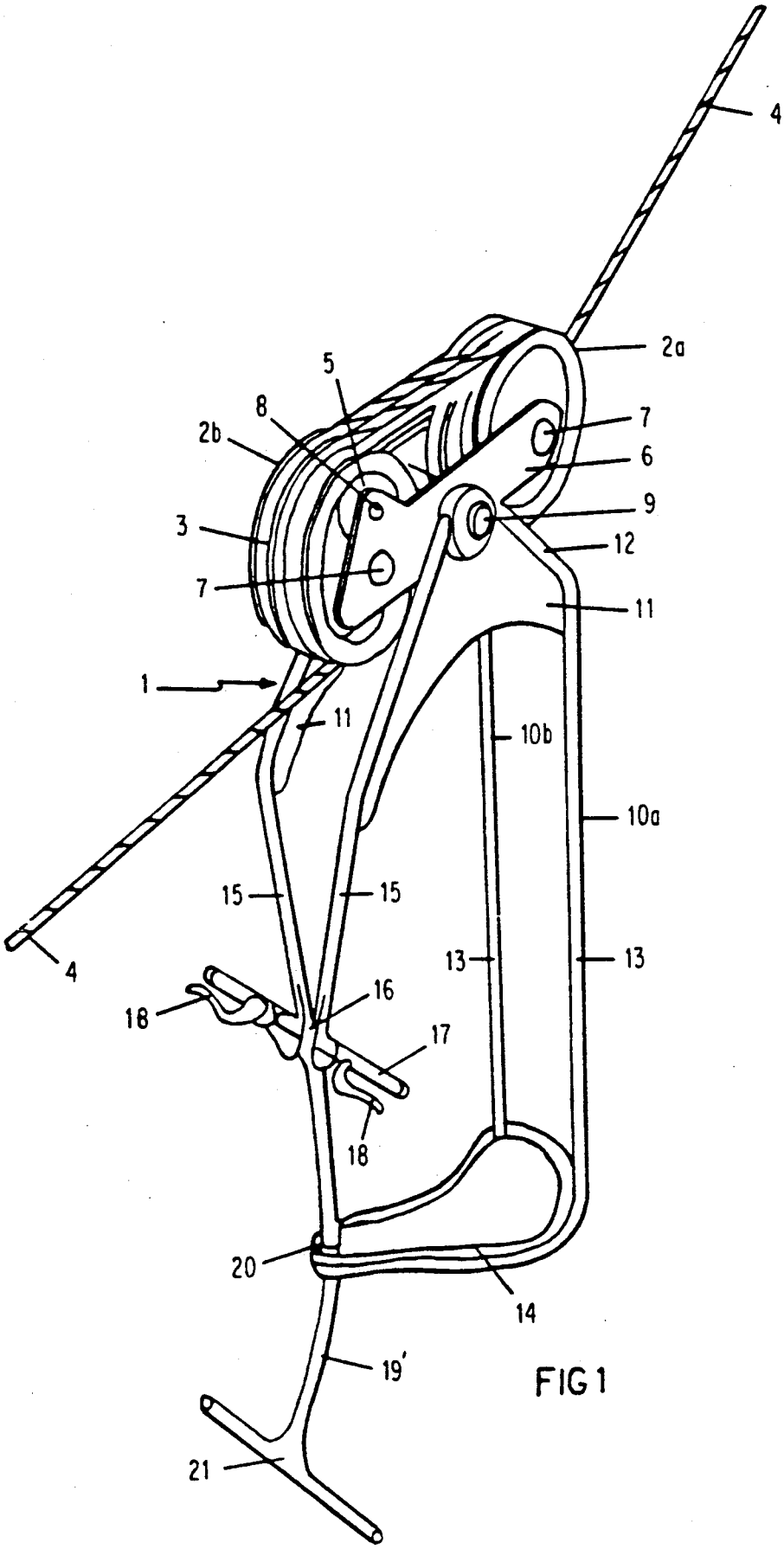
FIG. 1 is a view in perspective of the platform escape vehicle herewith invented.

As can be seen in the figures, the platform escape vehicle, which is the object of this invention, herewith referred to as (1), consists, at the top, of two sheaves (*2a*, *2b*) mounted on parallel shafts with double grooves (3), which run along a wire rope (4), sheave (*2b*) being provided with a regular type dynamic brake (not shown in the Figures) and sheave (*2a*) being provided with hand-operated shoe brakes, the sheaves (*2a*, *2b*) being connected to one another by parallel supporting straps (6) provided with joining means (7) and connecting means (8,5) for dynamic brake, sheaves (*2a*, *2b*) plus supporting parallel straps (6) being joined at their mid-point by link (9) to the body of the velhicle (1) which consists of two like shaped side pieces (*10a*, *10b*) consisting of upper like triangular-shaped round-cornered straps (11) surrounded by a tubular member (12), from the smaller side of the straps (11) a first tubular member (13) runs toward each other and around the bottom of a seat (14), and from the larger side of the straps (11) a second (15) practically meets at the mid-point (16) of handle-bars (17) with levers (18) at their side to operate hand-worked shoe brakes, the meeting point of tubular members (15) being the start of a third member (19) which curves outward as it runs down through hole (20) in the forward part of seat (14) until the bottom end thereof becomes the shape of an inverted T (21), upon which the derrickman rests his feet.

Therefore a platform escape vehicle is provided which is not dangerous since those that have to use it will not need to cling on to anything in order to keep their balance when coming down. All anyone has to do is to get into the vehicle (1), sit on its seat (14), hold handle-bars (17) and rest their feet on the inverted T-type of rod (21), the descent taking place by sheaves (*2a*, *2b*) running along steel rope (4) which fits into the grooves (3) in the sheaves, the vehicle being stopped by means of the dynamic braking action from sheave (*2b*) or hand-operated shoe brake action from sheave (*2a*).

It should be pointed out that in order to prevent slipping and to make the brakes inside the sheaves work better, two or three turns of the wire rope have to be made about sheaves (*2a*, *2b*), the dynamic braking being adjusted beforehand for operation at top speed and also being able to act as a second shoe style brake.

Figure 2:
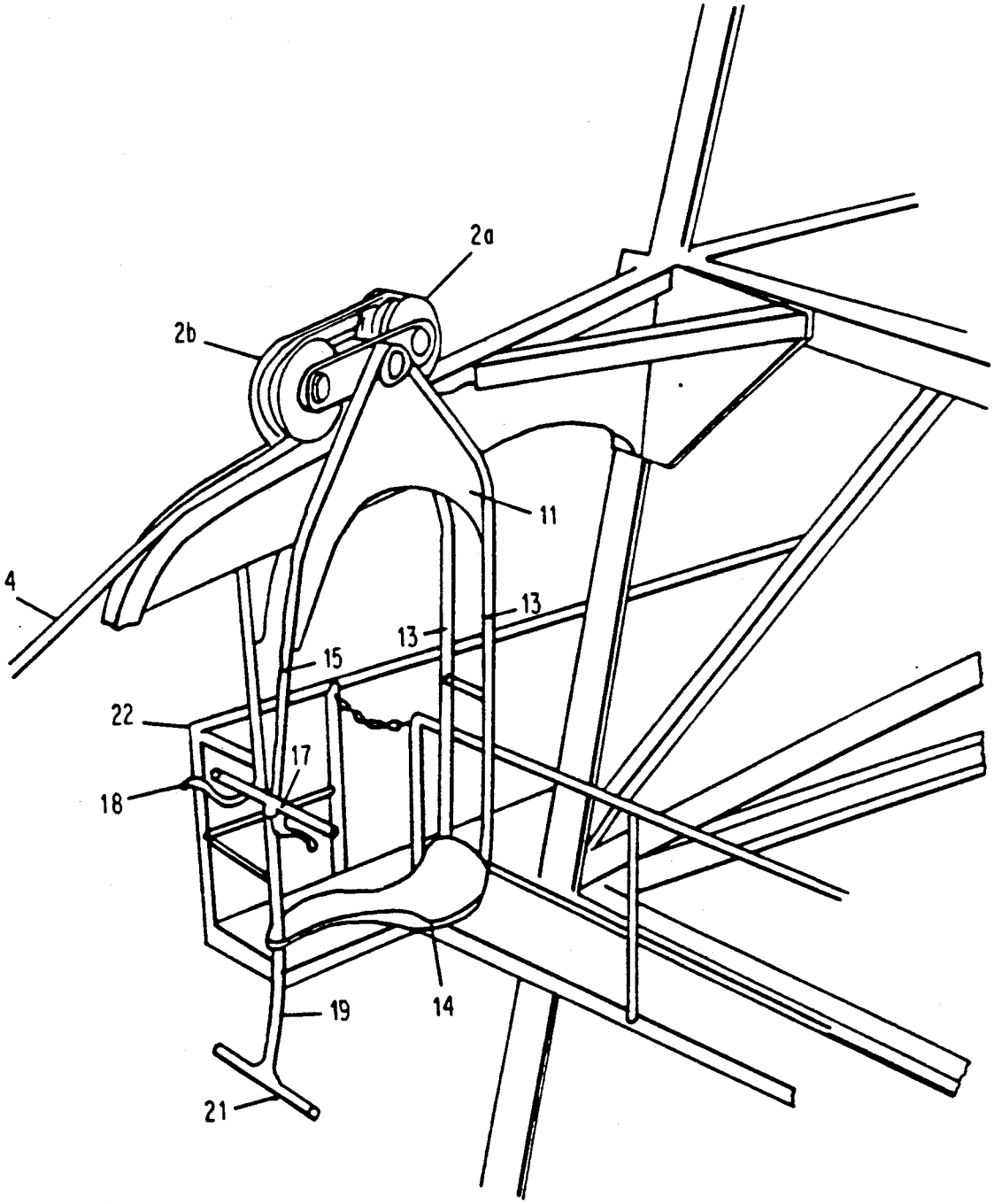
FIG. 2 is a view in perspective of the vehicle positioned on the side of the adapted approach way added to the derrickman's monkey board.

Furthermore, when vehicle (1) is installed and as may be seen from FIG. 2, for the escapee to be able to get away without having to climb and stand balanced upon the handrails of the monkey board, in order to get at the old style gear, an approach way (22) is provided alongside the vehicle (1) which makes it easy for escapee to get into the vehicle (1); so that there is now no danger the derrickman has to flee from his monkey-board on a drilling rig.

It should also be pointed out that vehicle (1) can be adjusted so as to operate even when vertical.

What is claimed is:

1. A platform escape vehicle, for swift escape of a derrickman from a monkey-board on a drilling rig, comprising: two double-grooved sheaves (2*a*, 2*b*) mounted on parallel shafts, a wire rope running through the grooves of said sheaves, said sheaves being joined by parallel supporting straps (6) provided with connecting means (8), said sheaves and said parallel supporting straps being joined at their mid-point to a body of the vehicle, said body having a seat (14) and handle-bars (17) and further comprising two like shaped side pieces (10*a*, 10*b*) each comprising a round-cornered triangular shaped piece (11), a first tubular member (13) extending from one side of each said triangular shaped piece around a bottom of the seat and a second tubular member (15) extending from the other side of each said triangular shaped piece and meeting at a mid-point of the handle-bars, said handle-bars being provided with levers (18), and a third tubular member (19) extending from said mid-point of said handle-bars, said third tubular member passing through a front end of said seat and having a bottom end 21 in the shape of an inverted T.

2. A platform escape vehicle as recited in claim 1, wherein said third tubular member curves away from said seat between said handle-bars and said bottom end.

* * * * *